US010816015B2

(12) United States Patent
Birkelund

(10) Patent No.: US 10,816,015 B2
(45) Date of Patent: Oct. 27, 2020

(54) EJECTOR ARRANGEMENT

(71) Applicant: Danfoss A/S, Nordborg (DK)

(72) Inventor: Michael Birkelund, Middelfart (DK)

(73) Assignee: DANFOSS A/S, Nordborg (DK)

( * ) Notice: Subject to any disclaimer, the term of this patent is extended or adjusted under 35 U.S.C. 154(b) by 388 days.

(21) Appl. No.: 15/738,841

(22) PCT Filed: May 25, 2016

(86) PCT No.: PCT/EP2016/061739
§ 371 (c)(1),
(2) Date: Dec. 21, 2017

(87) PCT Pub. No.: WO2016/206903
PCT Pub. Date: Dec. 29, 2016

(65) Prior Publication Data

US 2018/0180064 A1 Jun. 28, 2018

(30) Foreign Application Priority Data

Jun. 24, 2015 (EP) ..... 15173582

(51) Int. Cl.
*F04F 5/46* (2006.01)
*F04F 5/48* (2006.01)
(Continued)

(52) U.S. Cl.
CPC ..... *F04F 5/48* (2013.01); *F04F 5/18* (2013.01); *F04F 5/466* (2013.01); *F04F 5/54* (2013.01);
(Continued)

(58) Field of Classification Search
CPC ..... F04F 5/00–44; F04F 5/54; F04F 5/466; F25B 9/08
(Continued)

(56) References Cited

U.S. PATENT DOCUMENTS 2,106,362 A 1/1938 Stalcup
2,126,384 A 8/1938 Haines
(Continued)

FOREIGN PATENT DOCUMENTS

CN 1436992 A 8/2003
CN 103238036 A 8/2013
(Continued)

OTHER PUBLICATIONS

Tank Vapors: Optimize Ejector Sizing for Better Control, by Bryden, URL: https://www.chemengonline.com/tank-vapors-optimize-ejector-sizing-for-better-control/?printmode=1 (Year: 2011).*
(Continued)

*Primary Examiner* — Charles G Freay
*Assistant Examiner* — Thomas Fink
(74) *Attorney, Agent, or Firm* — McCormick, Paulding & Huber PLLC

(57) ABSTRACT

The invention relates to an ejector arrangement (1, 40) comprising a housing (11) and at least two ejectors (2, 3, 41, 42) arranged in said housing (11) along a common axis (13). Each ejector (2, 3, 41, 42) has a motive inlet (4, 5), a suction inlet (6, 7), an outlet (8, 9) and a valve element (23, 24, 43, 44). The task of the invention is to provide an ejector arrangement that allows for a good control of the mass flow of fluid through the ejector arrangement while keeping the construction simple. According to the invention the above task is solved in that the ejector arrangement (1, 40) comprises a common actuator (25, 55), that is arranged to engage at least two of the valve elements (23, 24, 43, 44) to open the motive inlets (4, 5).

20 Claims, 7 Drawing Sheets

(51) Int. Cl.
*F04F 5/54* (2006.01)
*F25B 41/00* (2006.01)
*F04F 5/18* (2006.01)
*F04F 5/24* (2006.01)

(52) U.S. Cl.
CPC ..... *F25B 41/00* (2013.01); *F04F 5/24* (2013.01); *F25B 2341/0015* (2013.01)

(58) Field of Classification Search
USPC ..... 417/151–198, 76–88
See application file for complete search history.

(56) References Cited

U.S. PATENT DOCUMENTS 3,220,210 A * 11/1965 Rachfal ..... F25B 1/08 62/170
3,255,708 A * 6/1966 Williams ..... F04F 5/466 417/176
3,380,649 A * 4/1968 Roberts ..... G21C 15/24 417/164
5,262,091 A * 11/1993 Narabayashi ..... F04F 5/461 261/21
5,799,831 A * 9/1998 Spriggs ..... B01F 5/0406 137/889
6,155,796 A * 12/2000 Schmalz ..... F04F 5/20 417/182
6,171,068 B1 * 1/2001 Greenberg ..... F04F 5/22 417/174
6,302,655 B1 * 10/2001 Popov ..... F04F 5/54 417/77
6,729,158 B2 5/2004 Sakai et al.
6,857,286 B2 2/2005 Ohta et al.
2004/0105760 A1 * 6/2004 Eisele ..... F04F 5/466 417/151
2005/0064255 A1 * 3/2005 Blaszczyk ..... H01M 8/04097 429/415
2005/0130008 A1 * 6/2005 Uozumi ..... F04F 5/466 429/415
2005/0173336 A1 * 8/2005 Arnaud ..... B01D 21/2433 210/512.1
2005/0279414 A1 * 12/2005 Kleppner ..... F04F 5/466 137/565.22
2006/0278282 A1 * 12/2006 Nagai ..... F04F 5/20 137/565.23
2007/0020114 A1 * 1/2007 McFarland ..... F04F 5/464 417/151
2009/0032125 A1 * 2/2009 Fukano ..... F04F 3/00 137/565.23
2009/0295170 A1 * 12/2009 Tell ..... F04F 5/44 290/1 A
2010/0045057 A1 * 2/2010 Tell ..... B25J 15/0675 294/183
2011/0123359 A1 * 5/2011 Schaaf ..... F04F 5/22 417/174
2014/0137553 A1 * 5/2014 Ulrey ..... F02B 37/16 60/602
2014/0291258 A1 * 10/2014 Wuerdig ..... B01F 5/0421 210/750
2018/0283331 A1 * 10/2018 Porras ..... F02M 37/025
2019/0255533 A1 * 8/2019 Wilmer ..... B01L 3/0279

FOREIGN PATENT DOCUMENTS

CN 103270379 A 8/2013
DE 10357801 A1 7/2004
JP 2007057222 A 3/2007
JP 2010014353 A 1/2010
RU 2133884 C1 7/1999
RU 2184880 C1 7/2002
RU 2317451 C1 2/2008

OTHER PUBLICATIONS

First Examination Report for Indian Serial No. 201717044676 dated Oct. 23, 2019.
International Search Report for Application No. PCT/EP2016/061739 dated Jul. 26, 2016.
Chinese Office Action and English Translation for Corresponding Chinese Application No. 201680037053.8.

* cited by examiner

EJECTOR ARRANGEMENT

CROSS-REFERENCE TO RELATED APPLICATION

This application is a National Stage application of International Patent Application No. PCT/EP2016/061739, filed on May 25, 2016, which claims priority to European Patent Application No. 15173582.6, filed on Jun. 24, 2015, each of which is hereby incorporated by reference in its entirety.

TECHNICAL FIELD

The invention relates to an ejector arrangement comprising a housing and at least two ejectors arranged in said housing, wherein each ejector has a motive inlet, a suction inlet, an outlet, and a valve element.

BACKGROUND ART

An ejector arrangement of this kind is for example known from JP 2010-014353 A. Therein a plurality of ejectors is arranged in parallel in a refrigeration cycle.

In refrigeration systems ejectors are used as a pump to increase the pressure of a fluid coming from the suction inlet. Ejectors (sometimes also called injectors) to this end use the Venturi effect to increase the pressure coming from the suction inlet by providing a high pressure motive fluid supplied by the motive inlet.

Depending on the requirements of the refrigeration system it may be necessary to have a large capacity of fluid per time provided by the ejectors. On the other hand, a single ejector has a limited capacity for high pressure fluid that can be provided at the outlet. For example, from the above JP 2010-014353 A it is therefore known to use several ejectors in parallel.

However, the above solution only works optimal if the refrigerant system runs at full capacity. While one may provide each ejector with control means for individual adjustment of the opening degree in order to adjust the total amount of fluid provided by the ejectors at the outlet, this complicates the construction of the ejector arrangement and therefore increases the costs of the refrigeration system.

SUMMARY

The object of the present invention therefore is to provide an ejector arrangement that allows to control the mass flow of fluid through the ejector arrangement while keeping the construction simple.

According to the present invention the above object is solved in that the ejector arrangement comprises a common actuator that is arranged to engage at least two of the valve elements to open the motive inlets.

With this solution the ejectors can all be opened between 0% and 100% allowing a good control of the mass flow of fluid through the ejectors. At the same time a common actuator for engaging and displacing the valve elements to open the individual motive inlets of the ejectors keeps the construction simple. The common actuator can be arranged to engage all of the valve elements at the same time or successively to open the motive inlets when the common actuator is displaced.

In a preferred embodiment the common actuator engages at least one of the valve elements before another valve element when the common actuator is displaced along a common axis. The common actuator may thus lift the individual valve elements to open the individual motive inlets one after another. This allows to gain a more gradual control of the mass flow of fluid through the whole injector arrangement. It is also possible that the common actuator engages two or more valve elements at the same time before engaging the next two or more valve elements.

In a further preferred embodiment each ejector is provided with a check valve or non-return valve at the suction inlet. Such a check valve or non-return valve may for example be a completely pressure controlled ball-valve or a ball-valve with a biasing member. This solution ensures that there is no risk of medium coming from the motive inlet flowing in the reverse direction through the suction inlet.

In a further preferred embodiment the housing comprises a cylindrical body around a common axis and the ejectors are arranged on a circular path around the common axis. This solution allows for a compact construction even if a large number of ejectors is used in the ejector arrangement. At the same time the construction may be kept simple because the common actuator may for example have a rotational symmetry around the common axis, in this case the cylinder axis of the cylindrical body of the housing.

Preferably at least one ejector has a larger flow capacity than the remaining ejectors. Preferably this ejector is the first ejector that is opened by the common actuator starting from the completely closed state of the ejector arrangement. This way, the ejector with the larger flow capacity is enabled to cope with the mixture of vapor and liquid that may typically be present during colder environmental conditions, e.g. during winter time. For example, the motive inlet with a larger flow capacity may have a motive inlet with a larger mean free flow cross section compared to the other motive inlets of the other ejectors. One may also chose the first two ejectors that are being opened by the common actuator to have a larger flow capacity than the remaining motive inlets of the other ejectors.

It is preferred that a common suction line is arranged in an end face of the housing connected to all suction inlets of the ejectors. This solution allows for a compact construction, in particular if the individual ejectors are sealed to the same end face of the common housing.

In a further preferred embodiment a common motive line connected to all motive inlets is arranged in the housing. The motive line may then for example be connected to a motive chamber in the housing. The valve elements may then block the flow of motive fluid from the motive line through the motive chamber and further through the motive inlets in the closed position of the valve elements.

It is preferred that when the common actuator is displaced towards an opening direction, the common actuator begins to open the next motive inlet only after the previously opened motive inlet is fully open. The individual ejectors are thus opened and activated one after another in such a way that only one ejector is being opened at a time while the common actuator is being displaced. All the other ejectors are either fully open or fully closed at the same time. This solution allows for a better proportional control of the mass flow through the ejector arrangement by controlling the common actuator.

It is preferred that when the common actuator is displaced towards an opening direction, the common actuator begins to open the next motive inlet before the previously opened motive inlet is fully open. This solution may be advantageous if the opening behavior of the individual ejectors near the fully open or fully closed position of the motive inlet is nonlinear. Consequently, one may still achieve a better proportional control of the whole ejector arrangement by controlling the common actuator.

It is preferred if at least two motive inlets are opened in parallel by the common actuator when the common actuator is displaced along the common axis. This solution is preferable if a large number of ejectors are used. It is however still possible that the common actuator always opens two, three, four or more motive inlets at the same time in such a way that only these two, three, four or more actuators are opened at the same time while all other ejectors are either fully open or fully closed. This solution allows for a faster increase in total mass flow by displacing the common actuator while still keeping a proportional control of the mass flow through the whole ejector arrangement.

It is preferred if the common actuator comprises a pilot valve wherein the pilot flow is controlled by an electric valve. This solution is preferable if the pressure differences in the ejector arrangement are large and it may thus be difficult to control a non-piloted valve. The electric valve may be a magnetic valve or a stepper motor valve.

In a preferred embodiment the common actuator comprises an actuating element with a plurality of orifices, each of which accommodates a valve element. The valve elements may in this case only move along the common axis inside the respective orifice. The orifices may have the shape of channels along the common axis inside the actuating element. The orifices may have a first end with a cross section that is smaller than the largest parallel cross section of the corresponding valve element. In this case the valve element may thus only fully enter or exit the orifice at the second end of the orifice. Preferably, the second end of the orifice may be closed, e.g. by a plug, after the valve element has been inserted. This allows for a simple assembly with the valve elements arranged in the actuating element.

It is preferred if the valve elements comprise a section with a larger cross section and a section with a smaller cross section, wherein at least two valve elements comprise sections with a smaller cross section that have a different length along a common axis. In this case the relative length of the sections of different cross section may be different for each valve element to adjust when the common actuator starts to displace the individual valve element while being displaced along the common axis. The sections may have the shape of two cylinders of different diameter, that are connected at an end face of the cylinders. The valve elements may comprise an annular shoulder that may engage a stop of the common actuator for each valve element. The length of orifices in which the valve elements may be received is preferably the same for all valve elements in this embodiment.

In a further preferred embodiment the housing comprises a circumferential wall, wherein the outlets are arranged radially outside the circumferential wall and the suction inlets are arranged radially inside the circumferential wall. This solution allows for a compact construction of the ejector arrangement, for example when the common housing comprises a cylindrical body. In the latter case the circumferential wall may also have a substantially cylindrical shape.

In another preferred embodiment each ejector is sealed to an end face of the housing. This way one may ensure that in a region encircled by the combination of the ejectors the suction flow has a flow path to all suction inlets of the injectors. On the other hand one may also ensure that in a region radially outside of the combined ejectors the fluid flow from the individual outlets of the ejectors may be guided, for example into a common outlet chamber.

Preferably a common outlet line connected to all ejector outlets is arranged in the housing. This common outlet line may for example be connected to an outlet chamber connected to all outlets of the individual ejectors.

Preferably all outlets are connected to an outlet chamber in the housing. This outlet chamber may, for example, be arranged radially outside a circumferential wall in the housing.

In a further preferred embodiment, a common motive line connected to all motive inlets is arranged in the housing.

BRIEF DESCRIPTION OF THE DRAWINGS

A preferred embodiment of the invention will now be described in more detail with reference to the drawings, wherein.

DETAILED DESCRIPTION

Figure 1:
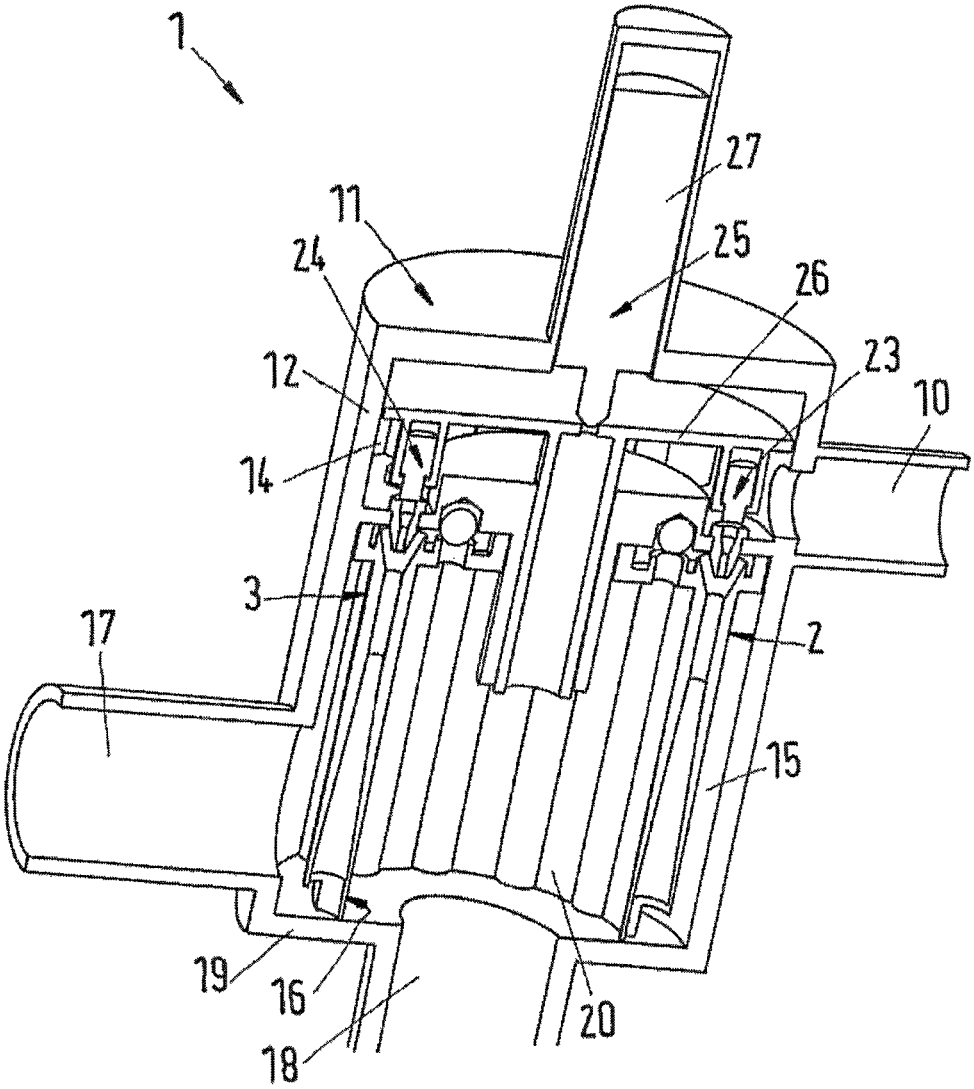
FIG. 1 shows an oblique sectional view of a first embodiment of an ejector arrangement according to the present invention.
Figure 2:
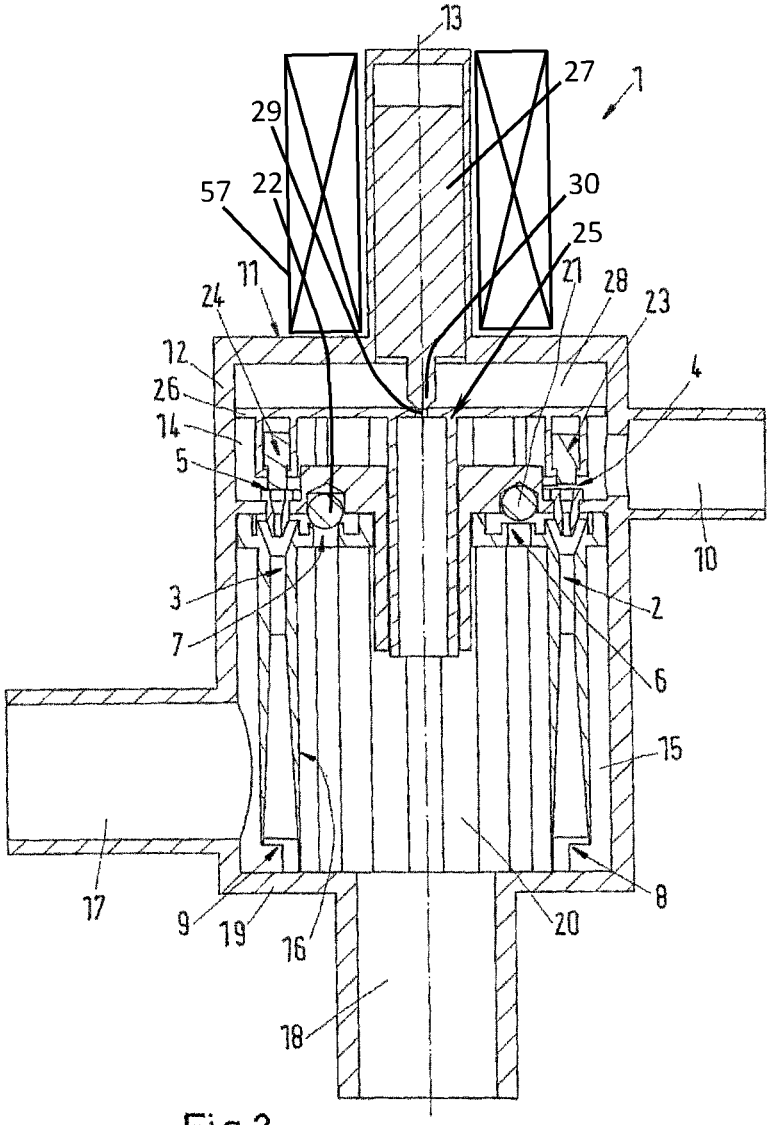
FIG. 2 shows another sectional view of the ejector arrangement according to FIG. 1, FIGS. 3 to 6 show the opening of one motive inlet by the common actuator in an ejector arrangement according to FIGS. 1 and 2.

Referring to FIGS. 1 and 2 an ejector arrangement 1 comprises a plurality of ejectors 2, 3. In this embodiment the ejector arrangement 1 comprises a total number of ten ejectors. Each ejector 2, 3 comprises a motive inlet 4, 5 as well as a suction inlet 6, 7 and an outlet 8, 9.

A motive line 10 provides high pressure motive fluid to all motive inlets 4, 5. All ejectors 2, 3 are arranged in a common housing 11. The housing 11 comprises a cylindrical body 12. The cylindrical body 12 is substantially rotationally symmetric around a common axis 13.

The motive fluid enters through the motive line 10 into a motive chamber 14 neighboring all motive inlets 4, 5.

All outlets 8, 9 of the ejectors 2, 3 lead the fluid into an outlet chamber 15. The outlet chamber is arranged radially outside a circumferential wall 16 in the housing 11. The outlet chamber 15 is connected to an outlet line 17.

All ejectors 2, 3 are arranged in parallel to the common axis 13. Both the motive line 10 and the outlet line 17 enter the housing 11 perpendicular to the common axis 13. A suction line 18 enters the common housing 11 parallel to the common axis 13. The suction line 18 is connected to an end face 19 of the housing 11.

All ejectors 2, 3 are sealed to the end face 19 of the housing 11. Radially inside the circumferential wall 16 a suction chamber 20 is arranged connected to the suction line 18 and all suction inlets 6, 7. At the suction inlets 6, 7 non-return valves 21, 22 are arranged, in this case ball-valves.

The ejector arrangement 1 further comprises one valve element 23, 24 for each ejector 2, 3. When an ejector 2, 3 is inactive the respective valve element 23, 24 closes the respective motive inlet 4, 5 such that no motive fluid coming from the motive line 10 can enter the ejector 2, 3.

The valve elements 23, 24 are arranged in a common actuator 25. The common actuator 25 comprises an actuating element 26 as well as a valve member 27. The common actuator 25 in this case comprises a pilot valve, wherein the pilot flow is controlled by a magnetic valve. The solenoid 57 of the magnetic valve is shown in FIG. 2.

The pilot valve here comprises a pilot chamber 28 as well as a pilot hole 29. The pilot hole 29 may be opened or closed by actuating the valve member 27. A tip 30 of the valve member 27 engages the pilot hole 29 and closes the pilot chamber 28 from a fluid connection to the suction line 18 when the common actuator is not activated.

Figure 3:
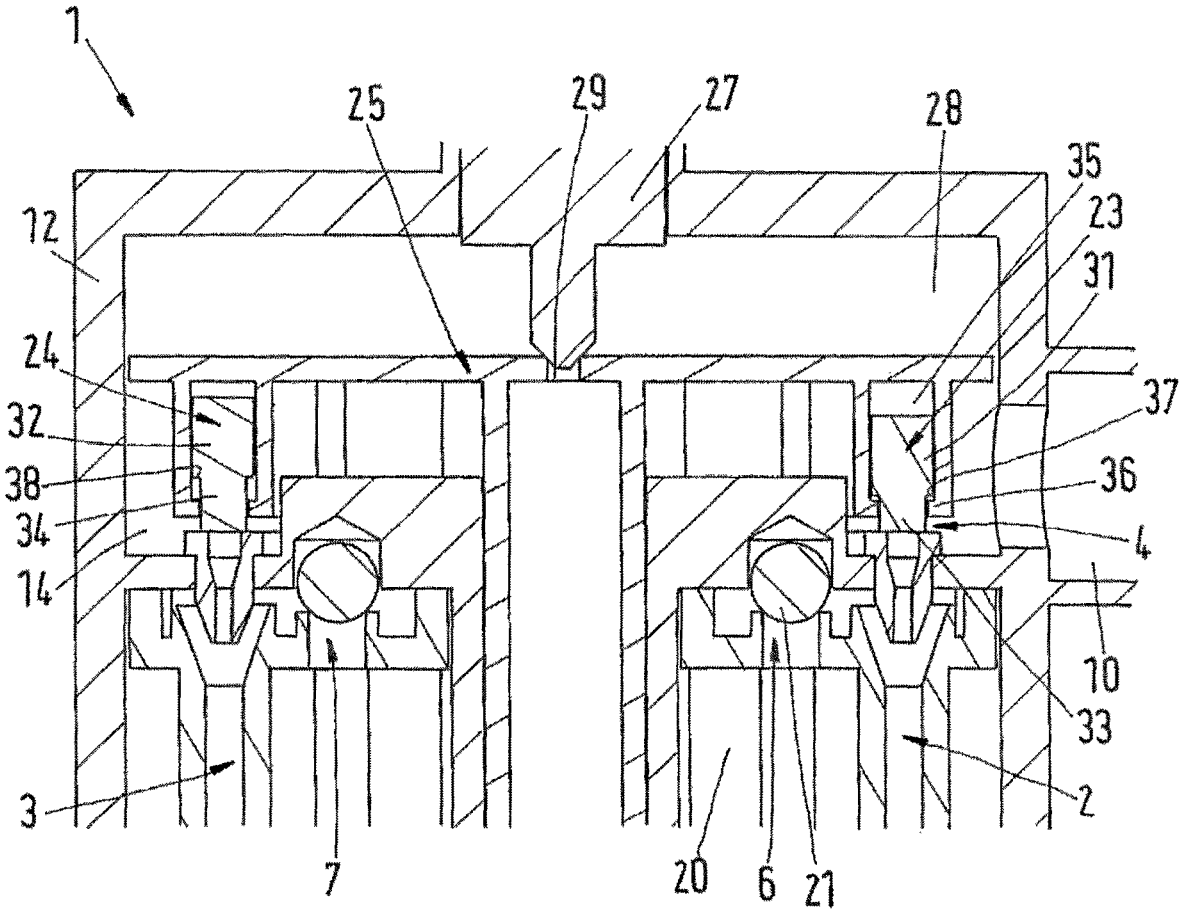

Referring to FIGS. 3 to 6 an enlarged portion of the ejector arrangement according to FIGS. 1 and 2 is shown. FIG. 3 shows the situation when all ejectors 2, 3 are closed, i.e. all valve elements 23, 24 close the motive inlets 4, 5 of all ejectors 2, 3. FIGS. 3 to 6 show how the ejector 2 is being opened by the common actuator 25 while the ejector 3 is kept closed. According to this embodiment this is achieved by the valve elements 23, 24 comprising sections 31, 32 with a larger cross section perpendicular to the common axis 13 as well as sections 33, 34 with a smaller cross section perpendicular to the common axis 13. Here the sections 31, 32, 33, 34 have the shape of cylinders, where the sections 31, 32 have a larger diameter than the sections 33, 34. Between the sections of different cross section and/or diameter an annular shoulder 37, 38 is arranged. The common actuator 25, in particular the actuating element 26, comprises orifices 35, in which the valve elements 23, 24 can be displaced parallel to the common axis 13. To this end the orifices 35 have the shape of a channel along the common axis 13. The common actuator 25, and in particular the actuating element 26, further comprise a stop for the valve element 23, 24 on one end of the orifices 35 to prevent the valve elements 23, 24 from exiting the orifices 35.

Figure 4:
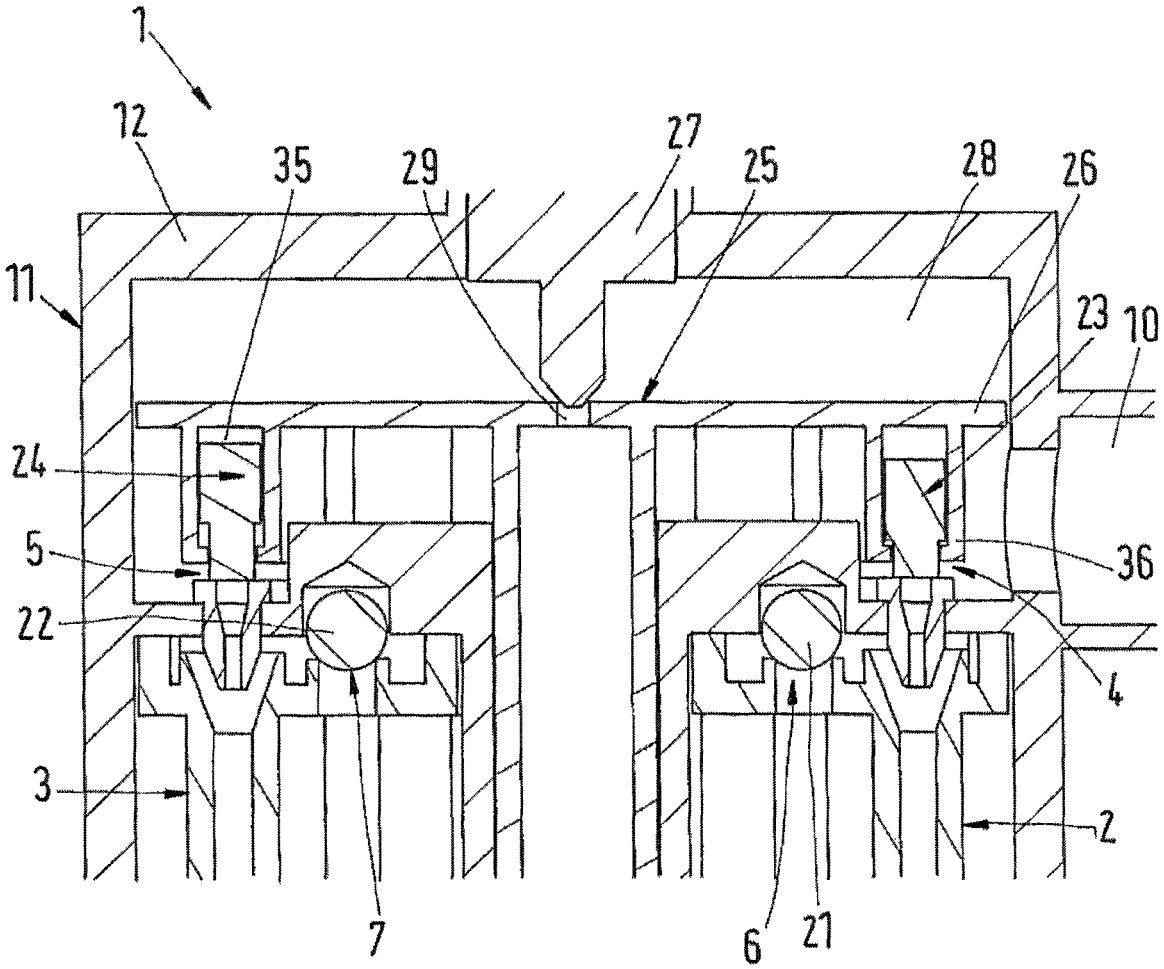

In FIG. 3 the valve member 27 of the common actuator 25 closes the pilot hole 29. In FIG. 4 however, the valve member 27 has been displaced by a short distance upwards along the common axis 13, thereby opening the pilot hole 29. Consequently, a fluid contact between the suction line 18 and the pilot chamber 28 is opened. Thereby, a pressure difference between the topside and the bottom side of the actuating element 26 results in a net force on the actuating element 26. This force leads to an upward movement of the actuating element 26 along the common axis 13.

Figure 5:
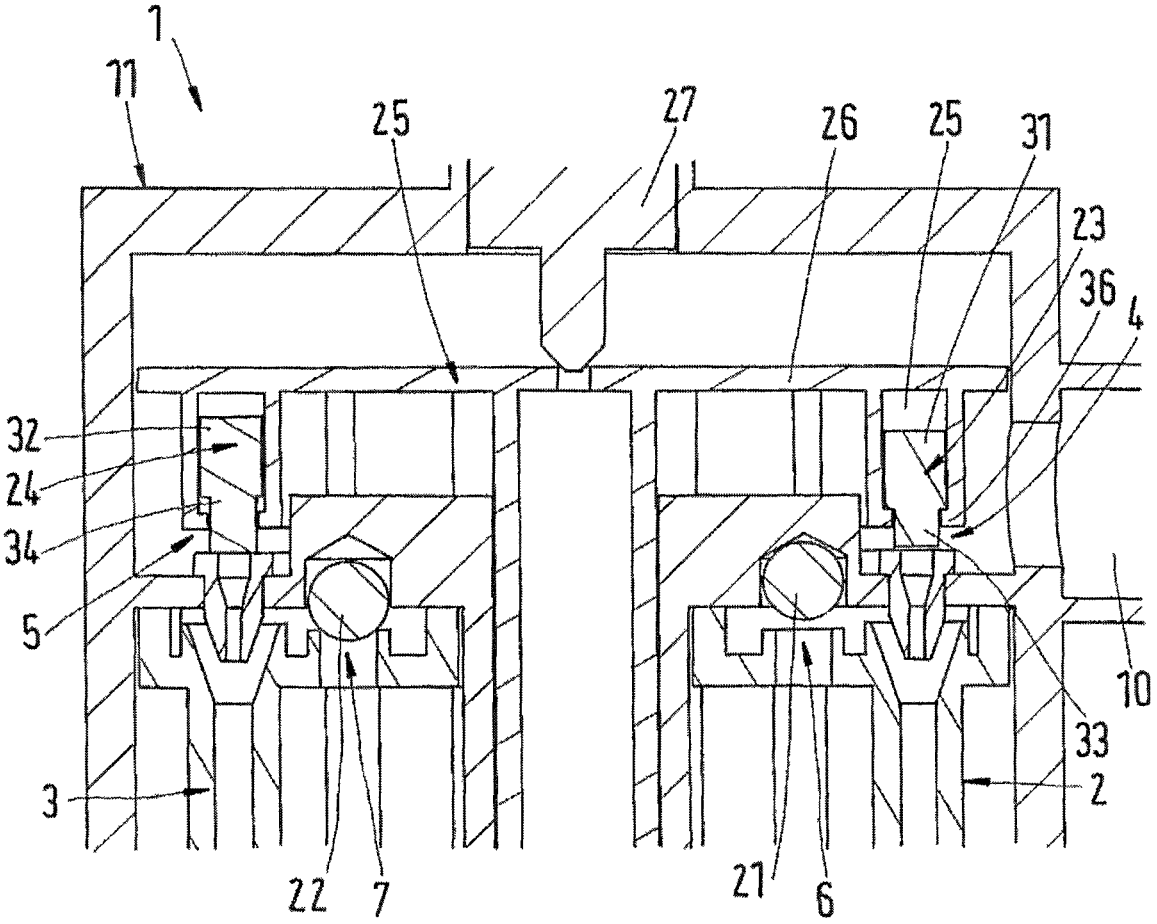
Figure 6:
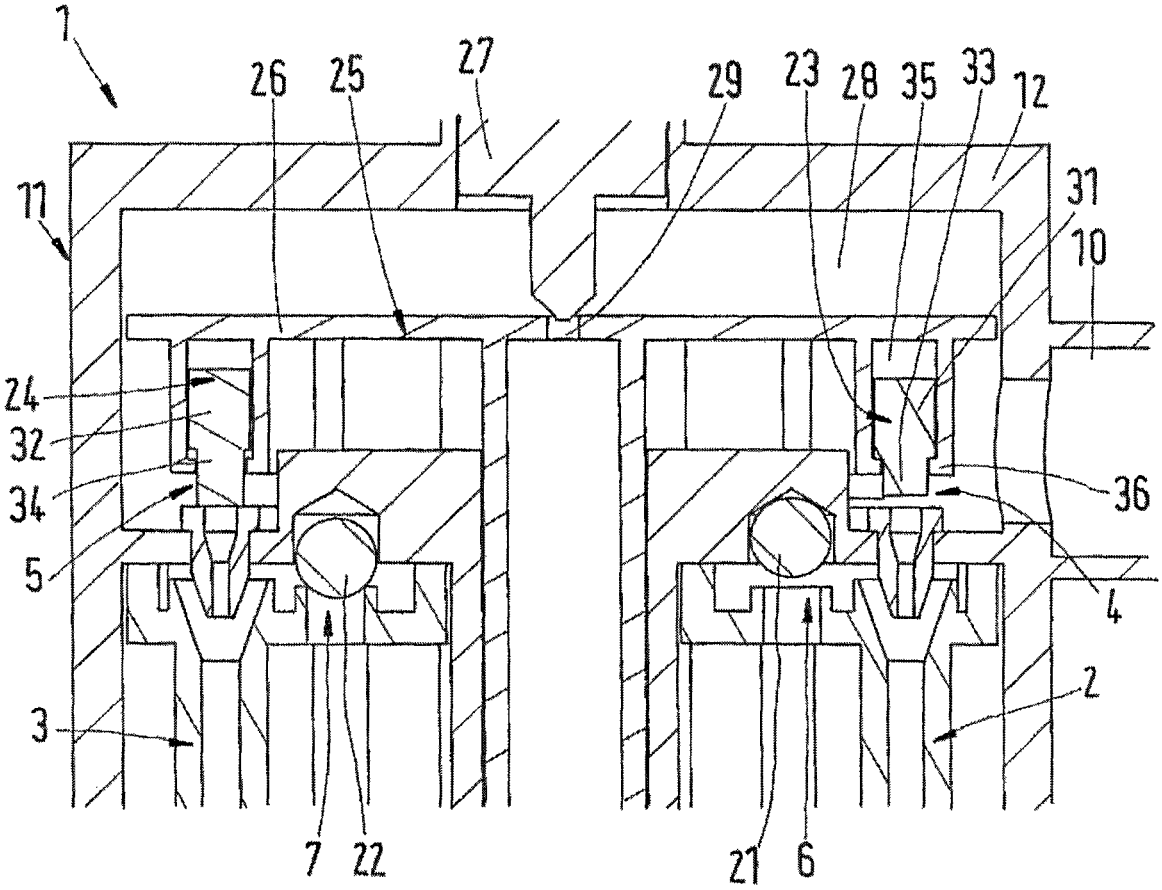

As can be seen in FIG. 5 the stop 36 corresponding to the valve element 23 has engaged the valve element 23 between the sections 31, 33 of different cross section at the annular shoulder 37, thereby lifting the valve element 23 and opening the motive inlet 4. Consequently, motive fluid can enter into the ejector 2, reducing the pressure on the ejector side of the suction inlet 6. The non-return valve 21 is opened by the force resulting from the pressure differences between the suction chamber 20 and the ejector side of the suction inlet 6. Fluid from the suction line 18 can thus enter the ejector 2 and mixes with the motive fluid coming from the motive line 10. The fluid exiting the ejector 2 at the outlet 8 has an increased pressure compared to the fluid at the suction line 18.

As can be seen in FIGS. 3 to 6 the second ejector 3 is not being activated, i.e. the motive inlet 5 is kept closed by the valve element 24. This is achieved by the section 34 of the valve element 24 being longer compared to the section 33 of the valve element 23. The stop 36 of the ejector 2 therefore engages the shoulder 37 of the valve element 23 earlier than the stop 36 of the ejector 3 engages the shoulder 38 of the valve element 24. However, if the valve member 27 is moved further upwards along the common axis 13 compared to the situation in FIG. 6 the actuating member 26 would be pushed further upwards by pressure differences, thereby also lifting the valve element 24 upwards and opening the motive inlet 5. As one can see in this embodiment the valve element 24 of the second ejector 3 stays in a closed position during all of the opening operation of the valve element 23 of the ejector 2. In other words, the second ejector 3 is only being opened after the first ejector 2 has been completely opened by the common actuator 25. By choosing the relative length of the individual valve elements 23, 24 one can therefore define positions of the actuating element 26 along the common axis 13 at which an individual valve element 23, 24 will be lifted upwards by the actuating element 26. Each ejector 2, 3 can thus be opened in a predetermined order. This allows for a better proportional control of the mass flow through the ejector arrangement.

Figure 7:
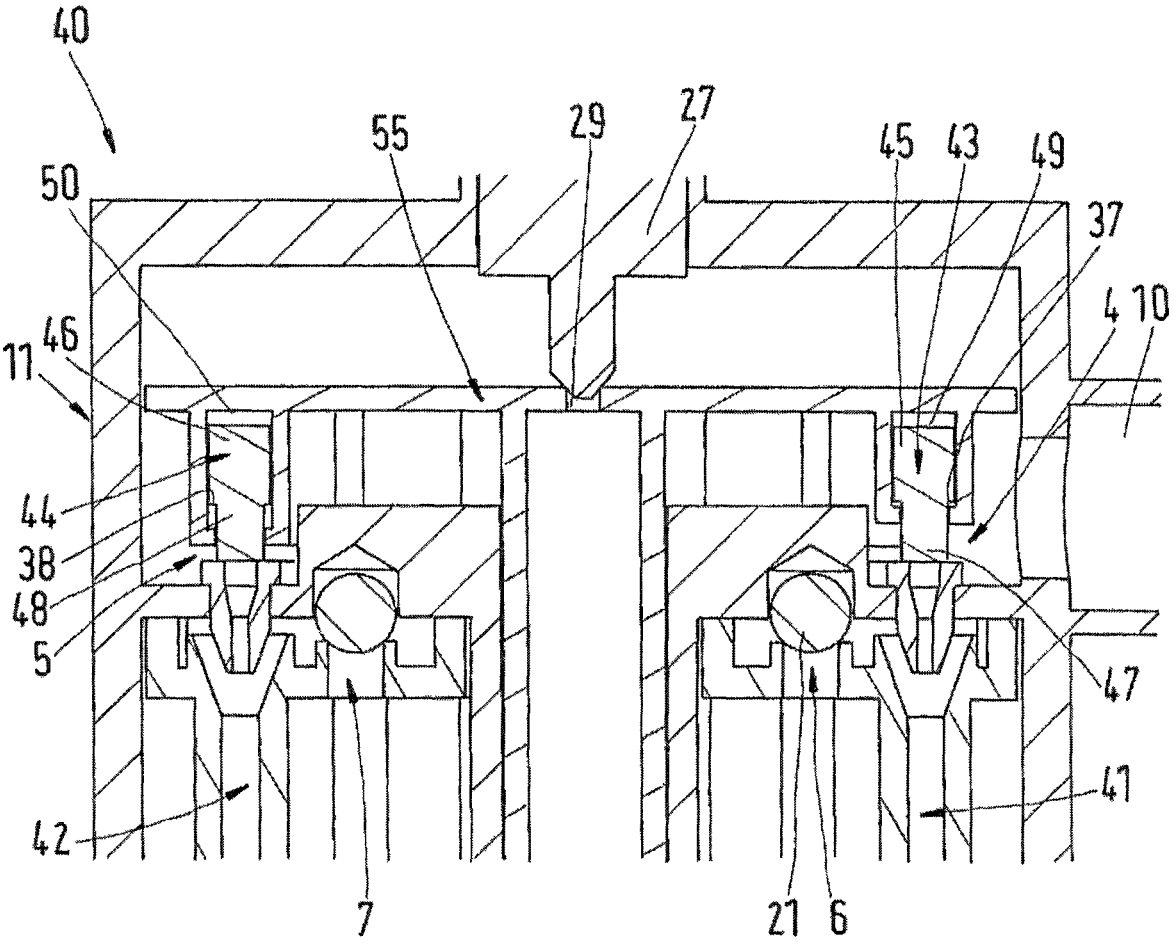
FIG. 7 shows a second embodiment of an ejector arrangement according to the present invention with valve positions corresponding to those in FIG. 3.

FIG. 7 shows a second embodiment of an ejector arrangement 40 according to the invention. Corresponding reference signs are denoted with the same numbers. The opening situation of the ejector arrangement 40 corresponds to the same situation as in FIG. 3, i.e. both explicitly shown ejectors 41, 42 are fully closed. In contrast to the first embodiment the valve elements 43, 44 here are identical. In other words, the sections 45, 46 with a larger cross section have the same length for both valve elements 43, 44 and the sections 47, 48 with a smaller cross section have the same length for both valve elements 43, 44.

The difference in the opening behavior between the individual ejectors 41, 44 in this embodiment is reached by having orifices 49, 50 with a different length for each ejector 41, 42. At the same time the stop 51 of the ejector 41 engages the shoulder 52 of the valve element 43 earlier than the stop 53 engages the shoulder 54 of the valve element 44 when the common actuator 55 is moved towards an opening direction, i.e. in this case upwards. The advantage of the second embodiment compared to the first embodiment is that the assembly of the ejector arrangement is simplified, because all valve elements 43, 44 are the same and thus there is no risk of a wrong assembly by inserting a valve element into a wrong orifice. The common actuator 55 in the second embodiment thus comprises an asymmetric actuating element 56 with orifices 49, 50 having a different length for each orifice 49, 50. According to the first embodiment in FIGS. 1 to 6 the orifices 35 of the actuating element 26 all have the same length along the common axis 13.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. An ejector arrangement comprising a housing and at least two ejectors arranged in said housing, wherein each ejector has a motive inlet, a suction inlet, an outlet and a valve element, wherein the ejector arrangement comprises a common actuator that is arranged to engage at least two of the valve elements to open the motive inlets, and wherein the outlets of the at least two ejectors are connected to a common outlet chamber of the housing.

2. The ejector arrangement according to claim 1, wherein, the common actuator engages at least one of the valve elements before another of the valve elements when the common actuator is displaced along a common axis.

3. The ejector arrangement according to claim 1, wherein, each of the ejectors are provided with a check valve or a non-return valve at the suction inlet.

4. The ejector arrangement according to claim 1, wherein, the housing comprises a cylindrical body around a common axis and the ejectors are arranged on a circular path around the common axis.

5. The ejector arrangement according to claim 1, wherein, at least one of the ejectors has a larger flow capacity than the remaining ejectors.

6. The ejector arrangement according to claim 1, wherein, a common suction line is arranged in an end face of the housing connected to all the suction inlets of the ejectors.

7. The ejector arrangement according to claim 1, wherein, a common motive line connected to all the motive inlets is arranged to enter the housing.

8. The ejector arrangement according to claim 1, wherein, when the common actuator is displaced towards an opening direction, the common actuator begins to open a next one of the motive inlets only after a previously opened one of the motive inlets is fully open.

9. The ejector arrangement according to claim 1, wherein, when the common actuator is displaced towards an opening direction, the common actuator begins to open a next one of the motive inlets before a previously opened one of the motive inlets is fully open.

10. The ejector arrangement according to claim 1, wherein, at least two of the motive inlets are opened in parallel by the common actuator when the common actuator is displaced along a common axis.

11. The ejector arrangement according to claim 1, wherein, the common actuator comprises a pilot valve, wherein the pilot flow is controlled by an electric valve.

12. The ejector arrangement according to claim 1, wherein, the common actuator comprises an actuating element with a plurality of orifices, each of which accommodates one of the valve elements.

13. The ejector arrangement according to claim 12, wherein, the length of at least two of the orifices along a common axis is different.

14. The ejector arrangement according to claim 1, wherein, each valve element comprises a first section and a second section, wherein the first section has a larger cross section than the second section, wherein the second sections of at least two of the valve elements have a different length along a common axis.

15. The ejector arrangement according to claim 1, wherein, the housing comprises a circumferential wall, wherein the outlets are arranged radially outside the circumferential wall and the suction inlets are arranged radially inside the circumferential wall.

16. The ejector arrangement according to claim 2, wherein, each of the ejectors is provided with a check valve or a non-return valve at the suction inlet.

17. The ejector arrangement according to claim 2, wherein, the housing comprises a cylindrical body around a common axis and the ejectors are arranged on a circular path around the common axis.

18. The ejector arrangement according to claim 3, wherein, the housing comprises a cylindrical body around a common axis and the ejectors are arranged on a circular path around the common axis.

19. The ejector arrangement according to claim 2, wherein, at least one of the ejectors has a larger flow capacity than the remaining ejectors.

20. The ejector arrangement according to claim 3, wherein, at least one of the ejectors has a larger flow capacity than the remaining ejectors.

* * * * *